US010473434B1

(12) United States Patent
Liu

(10) Patent No.: US 10,473,434 B1
(45) Date of Patent: Nov. 12, 2019

(54) BULLETPROOF MATERIAL, PRODUCTION METHOD THEREOF AND BULLETPROOF BACKPACK

(71) Applicant: SDL TECHNOLOGY CO., LTD., Qinzhou, Guangxi (CN)

(72) Inventor: Tak Nam Liu, Guangxi (CN)

(73) Assignee: SDL TECHNOLOGY CO., LTD., Qinzhou (CN)

( * ) Notice: Subject to any disclaimer, the term of this patent is extended or adjusted under 35 U.S.C. 154(b) by 0 days.

(21) Appl. No.: 16/164,781

(22) Filed: Oct. 18, 2018

(30) Foreign Application Priority Data

Aug. 22, 2018 (CN) ..... 2018 1 0962979

(51) Int. Cl.

| | |
|---|---|
| ***F41H 5/04*** | (2006.01) |
| ***F41H 1/02*** | (2006.01) |
| ***A45F 3/04*** | (2006.01) |
| ***F41H 5/08*** | (2006.01) |
| *A45F 4/02* | (2006.01) |

(52) U.S. Cl.
CPC ..... *F41H 1/02* (2013.01); *A45F 3/04* (2013.01); *F41H 5/0471* (2013.01); *F41H 5/08* (2013.01); *A45F 2004/023* (2013.01)

(58) Field of Classification Search
CPC ..... F41H 5/0414; F41H 5/0428; F41H 1/00; F41H 1/02; F41H 5/08
See application file for complete search history.

(56) References Cited

U.S. PATENT DOCUMENTS

| | | | | |
|---|---|---|---|---|
| 2009/0047502 | A1* | 2/2009 | Folaron | B32B 5/26 428/327 |
| 2012/0251432 | A1* | 10/2012 | Cooper | B01J 37/0215 423/447.3 |
| 2017/0028674 | A1* | 2/2017 | Wadley | C08K 7/00 |
| 2017/0241747 | A1* | 8/2017 | Ganor | B32B 5/024 |

* cited by examiner

*Primary Examiner* — J. Woodrow Eldred

(57) ABSTRACT

The present disclosure provides a novel bulletproof material, manufacture method thereof and a bulletproof backpack. The bulletproof material comprises a plurality of layers of bulletproof fiber cloths and shock-absorption layers, wherein each layer of bulletproof fiber cloth has a plurality of diamond-shaped reinforcing units, and an included angle is formed between two neighboring diamond-shaped reinforcing units of the adjacent bulletproof fiber cloths; a carbon nano layer is provided on the front side of each layer of bulletproof fiber cloth; the carbon nano layer comprises a plurality of diamond-shaped integrated carbon nano tube units; and the plurality of diamond-shaped integrated carbon nano tube units correspond to the plurality of diamond-shaped reinforcing units at positions.

8 Claims, 5 Drawing Sheets

BULLETPROOF MATERIAL, PRODUCTION METHOD THEREOF AND BULLETPROOF BACKPACK

CROSS REFERENCE TO RELATED APPLICATION

The present application claims priority to Chinese patent application No. 201810962979.9, entitled "A New Bulletproof Material, Production Method Thereof and Bulletproof Backpack", filed on Aug. 22, 2018, the entire content of which is incorporated herein by reference.

TECHNICAL FIELD

The present application relates to the field of daily necessities and civil technology, and in particular to a novel bulletproof material, the production method thereof and a bulletproof backpack containing the same.

BACKGROUND

Guns are very dangerous weapons. China has strict control over guns. However, guns are not controlled in some countries, such as the United States. Therefore, there are frequent shooting incidents in the United States. If a shooting incident occurs, the masses have no daily necessities to withstand the shooting currently, which leads to the masses having no protective measures during the shooting.

The existing bulletproof material cannot have both convenience and bulletproof performance, so the existing bulletproof material is poor in bulletproof effect.

SUMMARY

The embodiments of the present application provide a novel bulletproof material and the production method thereof, which may improve the effects of the bulletproof material, but not increase the weight thereof, so as to have the advantages of convenience and great bulletproof performance.

According to the first embodiment, the present application provides a novel bulletproof material. The bulletproof material comprises: a plurality of layers of bulletproof fiber cloths and shock-absorption layers, wherein each layer of bulletproof fiber cloth has a plurality of diamond-shaped reinforcing units, and an included angle is formed between two neighboring diamond-shaped reinforcing units of the adjacent bulletproof fiber cloths; a carbon nano layer is provided on the front side of each layer of bulletproof fiber cloth; the carbon nano layer comprises a plurality of diamond-shaped integrated carbon nano tube units; and the plurality of diamond-shaped integrated carbon nano tube units correspond to the plurality of diamond-shaped reinforcing units at positions.

Each diamond-shaped integrated carbon nano tube unit comprises five integrated carbon nano tubes, wherein four integrated carbon nano tubes form an outer diamond block diagram of the diamond-shaped integrated carbon nano tube unit, and the rest integrated carbon nano tube forms one central line of the outer diamond block diagram.

Preferably, the set of integrated carbon nano tube comprises n carbon nano tubes, and the n carbon nano tubes are arranged in random order (wherein the number n is an integer greater than or equal to 100).

Preferably, the diamond-shaped reinforcing unit has an angle of a diamond shape of 60°, 120°, 60°, 120°, and an angle of 30° is formed between the diamond-shaped reinforcing units between the adjacent layers of bulletproof fiber cloth.

Preferably, the shock-absorption layers are made from the D3O material, and a shock-absorption layer is provided on every five layers of bulletproof fiber cloths.

According to the second embodiment, the production method of the novel bulletproof material provided according to the first embodiment is provided. The production method comprises the following steps:

Acquiring a plurality of layers of bulletproof fiber cloths, and arranging a plurality of diamond-shaped reinforcing units on the bulletproof fiber cloths, thereby obtaining an initial bulletproof fiber cloth.

Continuously winding carbon nano tube continuums around a cylindrical horizontal drum in a high-temperature furnace under the action of air buoyancy, wherein the cylindrical horizontal drum comprises a plurality of diamond-shaped blocks corresponding to the plurality of diamond-shaped integrated carbon nano tube units in sizes, each diamond-shaped block comprises four outer block sides and one central line, and a region among the four outer block sides and the central line is a hollow region; after accumulatively continuously winding for a certain time, spraying alcohol on the surfaces of the obtained continuous integrated carbon nano tubes, and meanwhile, using cylindrical steel rollers to pressurize; and after cooling to room temperature, taking off the material from the cylindrical horizontal drum, thereby obtaining a self-standing nano carbon film.

Pressing the self-standing nano carbon film onto one surface of each layer of bulletproof fiber cloth in a cold press manner so as to form a bulletproof fiber cloth with integrated carbon nano tubes, and packaging the plurality of layers of bulletproof fiber cloths with integrated carbon nano tubes and the shock-absorption layers so as to obtain the novel bulletproof material.

According to the third embodiment, a bulletproof backpack is provided. The bulletproof backpack comprises the novel bulletproof material provided in the first embodiment, and further comprises an electronic device. The electronic device comprises: a processor, a communication module, a memory, a camera and a pressure sensor; and the communication module, the memory and the camera are respectively connected with the processor.

The pressure sensor is provided on the upper side of the double-shoulder strap, and the camera is provided on the front side of the double-shoulder strap.

The pressure sensor is configured to detect the pressure value of the double-shoulder strap.

The processor is configured to turn on the camera when the pressure value is greater than the pressure threshold.

The camera is configured to acquire an image.

The processor is configured to remind the user when the image is analyzed to determine that there is a shooting incident.

Preferably, a processor is configured to sample the first frame picture and the second frame picture with a set interval, extract the first group of N positions corresponding to the images of N people of the first frame picture, extract the second group of N positions corresponding to the images of the same N people of the second frame picture, acquire N distances between the second group of N positions and the first group of N positions, extract M distances greater than a set threshold from N distances, and determine that there is a shooting incident if M is greater than the set number. N is an integer greater than or equal to 2, and $M \leq N$.

Preferably, the bulletproof backpack further comprises a GPS chip.

The GPS chip is configured to locate a position to acquire GPS coordinates.

The processor is further configured to determine the shooting incident, determine the current position according to the GPS coordinates, acquire the secure position around the current position, generate a path between the secure position and the current position, and provide the path to the user by voice prompting.

The embodiment of the present application is implemented with the following beneficial effects.

It can be seen that the plurality of diamond-shaped reinforcing units according to the embodiment of the present application are provided to improve the bulletproof performance of the bulletproof fiber cloth. Furthermore, in order to improve the strength of the diamond-shaped reinforcing units, the plurality of diamond-shaped integrated carbon nano tube units are laminated on the outer surfaces of the plurality of diamond-shaped reinforcing units, and the central line of the one integrated carbon nano tube is provided so that the central line may divide each diamond-shaped reinforcing unit into two triangles and the bulletproof performance is better improved by utilizing the stability of the triangle. Moreover, the bulletproof material takes the plurality of layers of fiber cloths and the carbon nano tubes as the base material, wherein the weight of the material is very light, so that the bulletproof material has the characteristic of convenience. As shown in FIG. 1, the bulletproof fiber cloth may comprise a plurality of diamond-shaped reinforcing units. The diamond-shaped reinforcing units are provided to effectively relieve the impact of the bullet, especially to better relieve the rotary impact of the bullet, but the disadvantage is: for the edge position (i.e., four sides) of the diamond-shaped reinforcing unit 30, the structure is relatively weak. In order to solve this problem, the inventor has shifted the plurality of layers of bulletproof fibers by an angle, accordingly no matter what position the bullet hits, there are more diamond-shaped reinforcing units to weaken the impact of the bullet so that the entire bulletproof fiber cloth relieves the impact of the bullet and the bulletproof effect is improved.

BRIEF DESCRIPTION OF THE DRAWINGS

In order to more clearly illustrate the technical solutions in the embodiments of the present application, the drawings to be used in the description of the embodiments will be briefly described below. It is obvious that the drawings in the following description are some embodiments of the present application. Those skilled in the art may also obtain other drawings based on these drawings without paying creative work.

DESCRIPTION OF THE EMBODIMENTS

The technical solutions of the embodiments of the present application will be described clearly and fully below in combination with drawings in the embodiments of the present application. It is apparent that the described embodiments are merely part of embodiments of the present application rather than all embodiments. Other embodiments achieved by those skilled in the art based on the embodiments in the present application without paying creative work will also fall into the scope of protection of the present application.

The term such as "first," "second," "third" and "fourth" in the description and claims of the present application and the drawings is used to distinguish different objects, rather than describe a specific order. Furthermore, the term such as "comprising", "having" or any variation thereof is intended to encompass non-exclusive inclusion. For example, a process, method, system, product, or device comprising a series of steps or units is not limited to the listed steps or units, but may further comprise steps or units not listed, or preferably further comprises other steps or units inherent to such a process, method, product, or device.

References to "embodiment" herein mean that a particular feature, result, or characteristic described in connection with the embodiments may be comprised in at least one embodiment of the present application. This term existing at various positions in the specification does not necessarily refer to the same embodiment, and is not an independent or alternative embodiment that is mutually exclusive from other embodiments. Those skilled in the art will explicitly and implicitly understand that the embodiments described herein may be combined with other embodiments.

Figure 1:
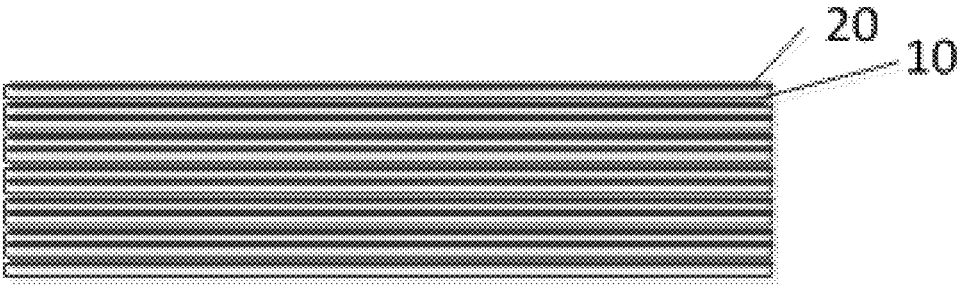
FIG. 1 is a schematic diagram illustrating the novel bulletproof material according to the present application.
Figure 1A:
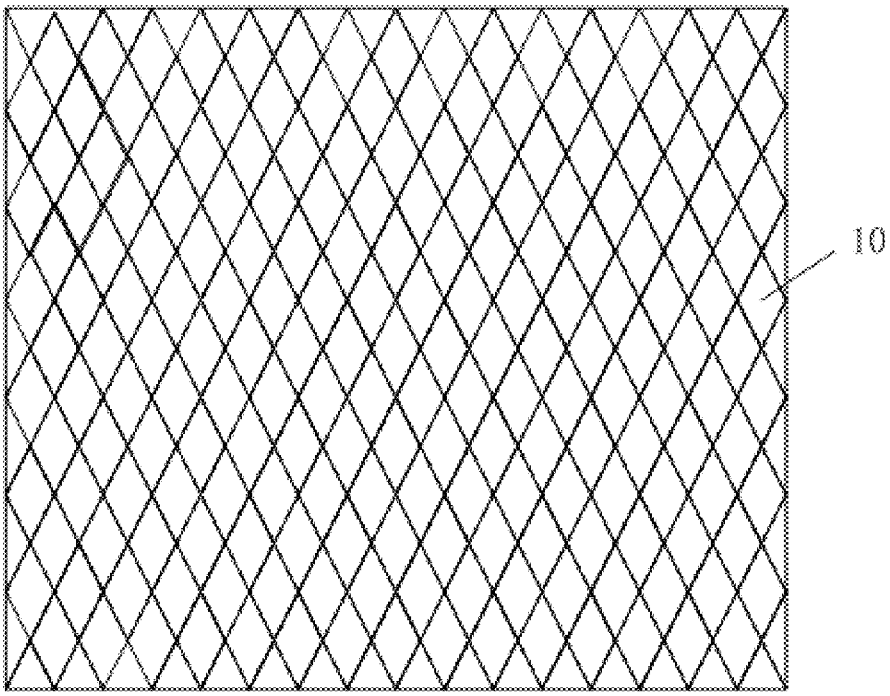
FIG. 1*a* is a schematic diagram illustrating the structure of a single-layer fiber cloth according to the present application.
Figure 1B:
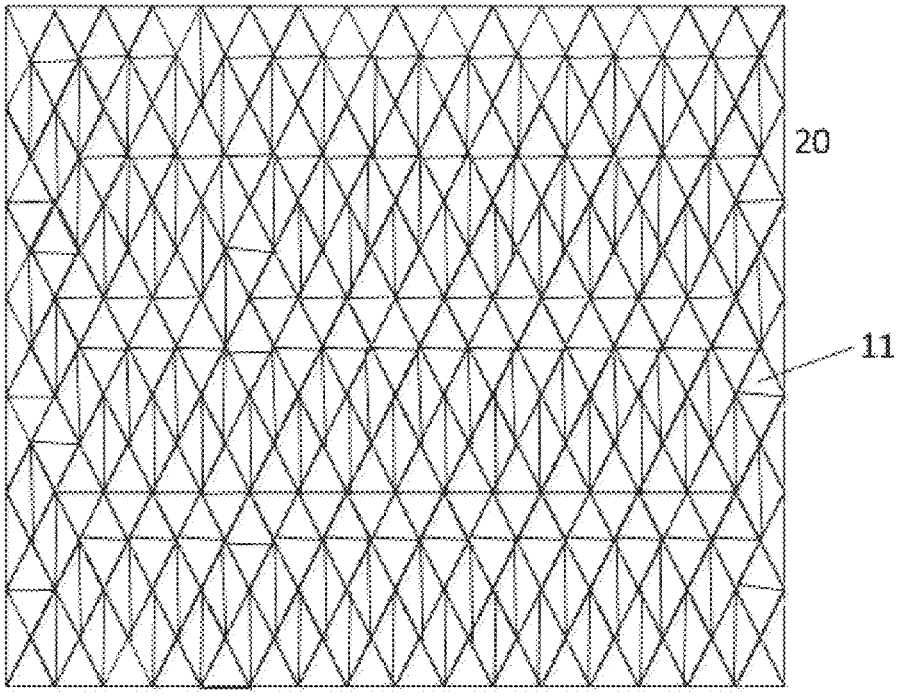
FIG. 1*b* is a schematic diagram illustrating the structure of a carbon nano layer according to the present application.

As shown in FIG. 1, the present application provides a novel bulletproof material. The bulletproof material comprises: a plurality of layers of bulletproof fiber cloths and shock-absorption layers (as shown in FIG. 1*a*), wherein each layer of bulletproof fiber cloth consists of a plurality of diamond-shaped reinforcing units 10, and an included angle is formed between two neighboring diamond-shaped reinforcing units of the adjacent bulletproof fiber cloths; a carbon nano layer is provided on the front side of each layer of bulletproof fiber cloth; the carbon nano layer 20 comprises a plurality of diamond-shaped integrated carbon nano tube units 11; the plurality of diamond-shaped integrated carbon nano tube units 11 (as shown in FIG. 1*b*) correspond to the plurality of diamond-shaped reinforcing units 10 at positions; and each diamond-shaped integrated carbon nano tube unit 11 comprises five integrated carbon nano tubes, wherein four integrated carbon nano tubes form an outer diamond block diagram of the diamond-shaped integrated carbon nano tube unit, and the other one integrated carbon nano tube forms one central line of the outer diamond block diagram.

The plurality of diamond-shaped reinforcing units are provided to improve the bulletproof performance of the bulletproof fiber cloth. Furthermore, in order to improve the strength of the diamond-shaped reinforcing units, the plurality of diamond-shaped integrated carbon nano tube units are laminated on the outer surfaces of the plurality of diamond-shaped reinforcing units, and the central line of the one integrated carbon nano tube is provided in such a way that the central line may divide each diamond-shaped reinforcing unit into two triangles and the bulletproof performance is better improved by utilizing the stability of the triangle. Moreover, the bulletproof material takes the plurality of layers of fiber cloths and the carbon nano tubes as the base material, wherein the weight of the material is very light, so that the bulletproof material has the characteristic of convenience. As shown in FIG. 1, the bulletproof fiber cloth may comprise a plurality of diamond-shaped reinforcing units. The diamond-shaped reinforcing units are provided to effectively relieve the impact of the bullet, especially to better relieve the rotary impact of the bullet, but the disadvantage is: for the edge position (i.e., four sides) of the diamond-shaped reinforcing unit 10, the structure is relatively weak. In order to solve this problem, the inventor has shifted the plurality of layers of bulletproof fibers by an angle, accordingly no matter what position the bullet hits, there are more diamond-shaped reinforcing units to weaken the impact of the bullet so that the entire bulletproof fiber cloth relieves the impact of the bullet and the bulletproof effect is improved.

Figure 2:
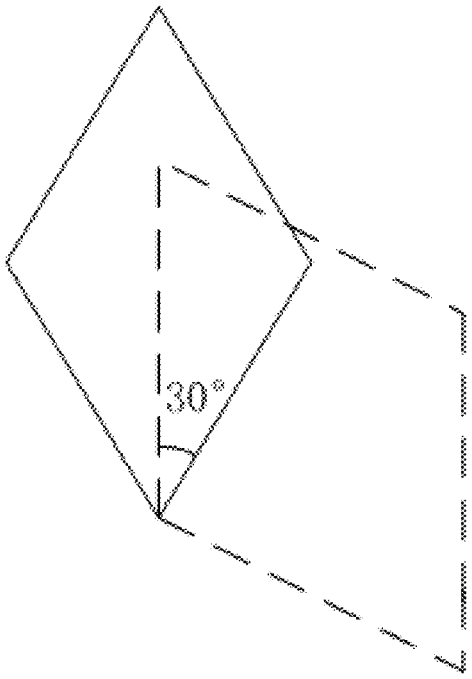
FIG. 2 is a schematic diagram illustrating the angle of a diamond-shaped reinforcing block of a 2-layer bulletproof fiber cloth according to the present application.

Preferably, referring to FIG. 2, the above diamond-shaped reinforcing unit has an angle of a diamond shape of 60°, 120°, 60°, 120°, and an angle of 30° is formed between the diamond-shaped reinforcing units between the adjacent layers.

Preferably, the shock-absorption layers are made from the D3O material, and a shock-absorption layer is provided on every five layers of bulletproof fiber cloths so that the bulletproof effect is improved.

With this configuration, each diamond-shaped side line may be located in the center of the diamond-shaped reinforcing block of the adjacent layers. The center position can effectively improve the bulletproof ability of the diamond-shaped reinforcing block, which can achieve the level of a bulletproof for 9 mm gun. That is, the bulletproof level can be Level I, Level II A, or Level II, which is effectively bulletproof.

Preferably, the above integrated carbon nano tube comprises n carbon nano tubes, and the n carbon nano tubes are arranged in random order.

Figure 3:
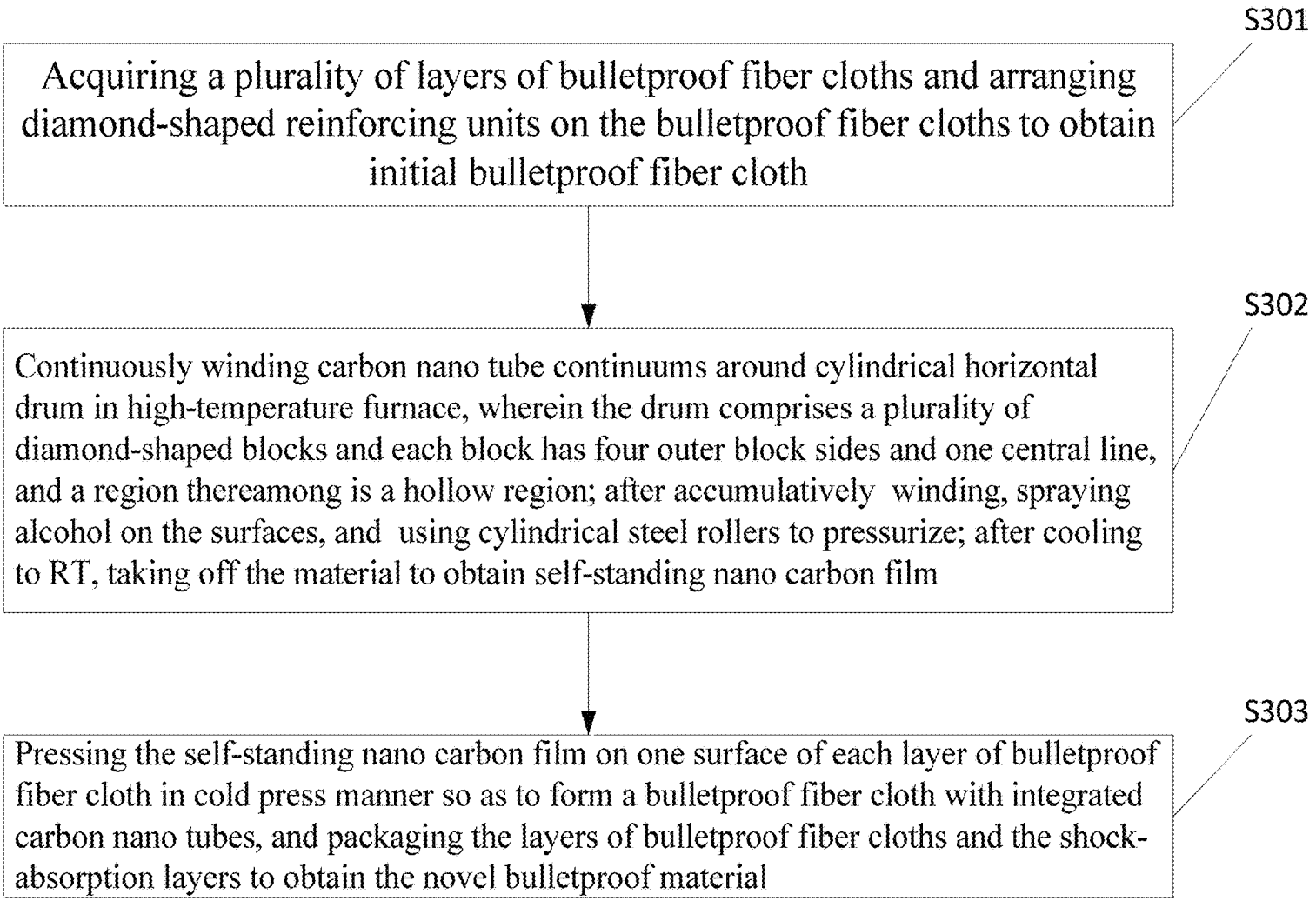
FIG. 3 is a schematic diagram illustrating the flow of the production method according to the present application.

Referring to FIG. 3, FIG. 3 provides a production method of the bulletproof material. As shown in FIG. 3, the production method comprises the following steps:

Step S301, acquiring a plurality of layers of bulletproof fiber cloths, and arranging a plurality of diamond-shaped reinforcing units on the bulletproof fiber cloths, thereby obtaining an initial bulletproof fiber cloth.

Step S302, continuously winding carbon nano tube continuums around a cylindrical horizontal drum in a high-temperature furnace under the action of air buoyancy, wherein the cylindrical horizontal drum comprises a plurality of diamond-shaped blocks corresponding to the plurality of diamond-shaped integrated carbon nano tube units in sizes, each diamond-shaped block comprises four outer block sides and one central line, and a region among the four outer block sides and the central line is a hollow region; after accumulatively continuously winding for a certain time, spraying alcohol on the surfaces of the obtained continuous integrated carbon nano tubes, and meanwhile, using cylindrical steel rollers to pressurize (under the pressure of about 3 Mpa); after cooling to room temperature, taking off the material from the cylindrical horizontal drum, thereby obtaining a self-standing nano carbon film.

Step S302, the plurality of diamond-shaped blocks are provided to help the carbon nano tubes form the film comprising the plurality of diamond-shaped integrated carbon nano tubes. The hollow region does not block the carbon nano tube continuums so that the integrated carbon nano tubes are formed only at the four outer block sides and the central lines of the plurality of diamond-shaped blocks and the shape of the plurality of diamond-shaped integrated carbon nano tube units may be formed.

Step S303, pressing the self-standing nano carbon film on one surface of each layer of bulletproof fiber cloth in a cold press manner (under the pressure of 6-7 Mpa for more than 30 min) so as to form a bulletproof fiber cloth with integrated carbon nano tubes, and packaging the plurality of layers of bulletproof fiber cloths with integrated carbon nano tubes and the shock-absorption layers so as to obtain the novel bulletproof material.

Figure 4:
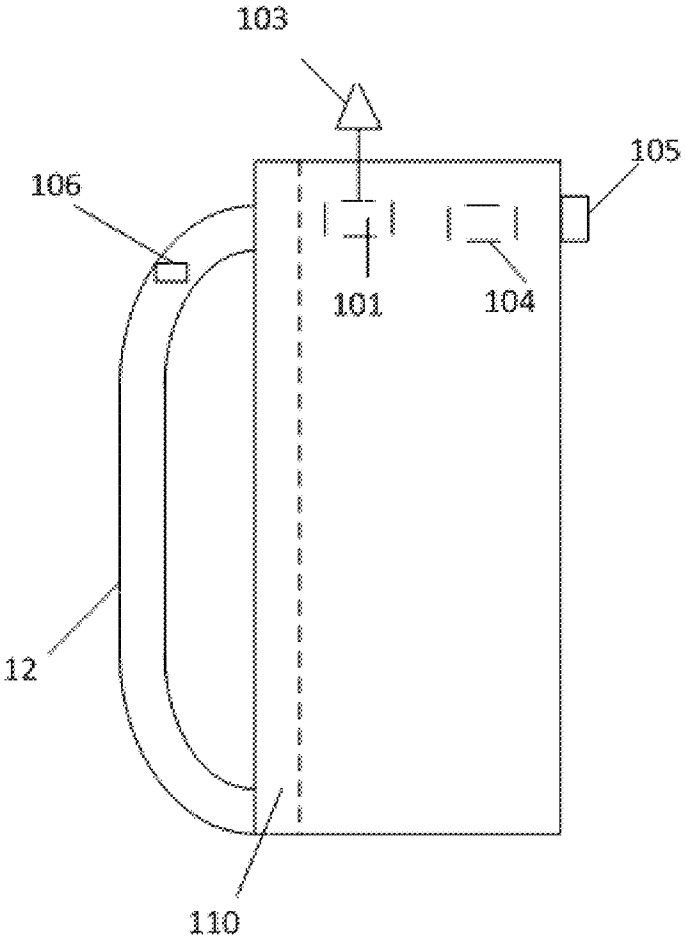
FIG. 4 is a schematic diagram illustrating the structure of the bulletproof backpack according to the present application.
Figure 5:
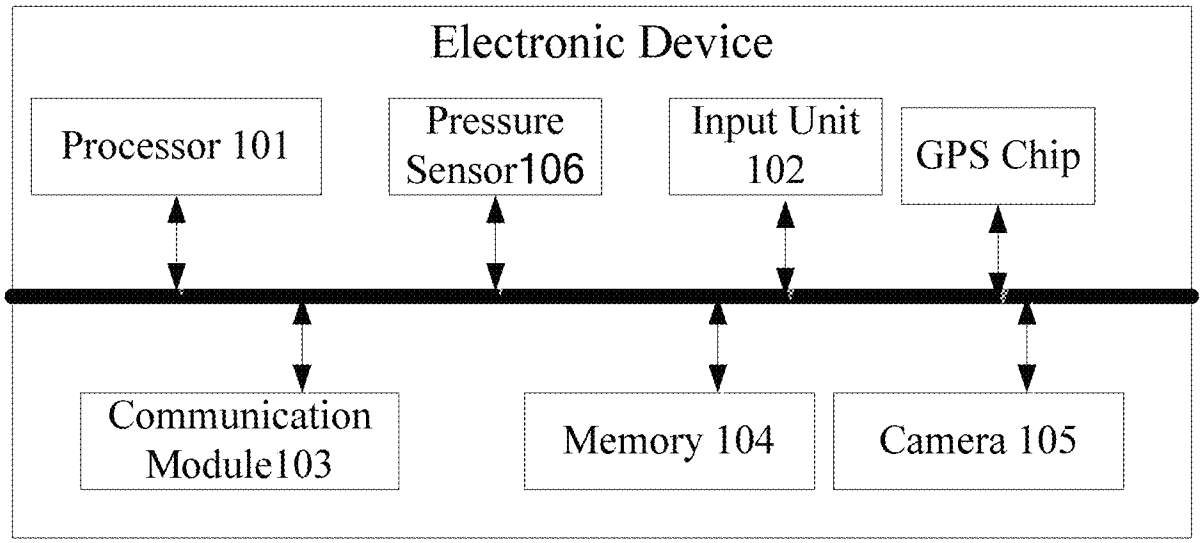
FIG. 5 is a diagram illustrating the structure of an electronic device of the bulletproof backpack according to the present application.

Preferably, as shown in FIG. 4, the present application further provides a bulletproof backpack. The bulletproof backpack comprises: the above novel bulletproof material 110 and an electronic device. As shown in FIG. 5, the electronic device may comprise: a processor 101, an input unit 102 (optional), a communication module 103, a memory 104, a camera 105, a pressure sensor 106, and other matching components, such as a battery, a speaker, a vibration motor, and the like. Refer to the configuration of a smart phone or a tablet for its specific structure, for example.

The pressure sensor 106 is provided on the upper side of the double-shoulder strap 12, and the pressure sensor 106 is configured to detect the pressure value of the double-shoulder strap.

The processor 101 is configured to turn on the camera 105 to acquire an image when the pressure value is greater than the pressure threshold, and remind the user when the image is analyzed to determine that there is a shooting incident.

Reminding the user may include a prompt by audio or by other means, such as by vibration or other means.

Analyzing the image to determine that there is a shooting incident may specifically comprise: a processor 101 configured to sample a first frame picture and a second frame picture with a set interval (for example, 20 frames or 30 frames), extract a first group of N positions corresponding to the images of N people of the first frame picture, extract a second group of N positions corresponding to the images of the same N people of the second frame picture, acquire N distances between the second group of N positions and the first group of N positions, extract M distances greater than a set threshold from N distances, and determine that there is a shooting incident if M is greater than the set number. N is an integer greater than or equal to 2, and $M \leq N$.

The principle of this technical solution is that the video and the file reacted to the shooting incident are analyzed with certain characteristics that a large number of people are in a disorderly moving state within a certain time within the video, and the number of the people is still relatively large. In this way, the inventor samples the first frame picture and the second frame picture of the set interval, and compares the two pictures to determine whether a large number of people are in a moving state. First, since the running speed of people is limited due to the relatively short time within the set interval, there will not be greatly difference between the positions of people of the two frame pictures. In this way, it is possible to analyze whether people are in a running state. In addition, since the backgrounds in which the two frame pictures are taken are similar, that is, the reference objects are the same, the number of pixel points between the reference objects and the N people can substantially determine the position corresponding to the N people, specifically comprising the fact that if the difference of pixel points between the corresponding people of the N people of the two frame pictures and the same reference object is greater than the set difference, it is determined that the distance of the people between the two frames is greater than the set threshold. Of course, in practical applications, the difference between the distances of the people of the two frame pictures can also be determined by other means. Therefore, the present application can automatically judge the situation of the back, thereby realizing a reminder to the shooting incident on the back of the user and improving security.

The camera 105 may be provided on the front side of the bulletproof backpack.

Preferably, the bulletproof backpack may further comprise a GPS chip, which may be integrated in the processor and is configured to locate a position to acquire GPS coordinates;

The processor 101 is further configured to determine the shooting incident, determine the current position according to the GPS coordinates, acquire the secure position around the current position, generate a path between the secure position and the current position, and provide the path to the user by voice prompting.

This technical solution realizes positioning in combination with GPS coordinates. After the shooting incident is determined, the current position is positioned according to the GPS coordinates, the secure position is acquired, and the path is generated, thereby avoiding the danger caused by the user running around and improving the security of the user.

In the above embodiments, the various embodiments are described in different focuses, and the parts that are not detailed in a certain embodiment may refer to the related descriptions of other embodiments.

In the embodiments provided by the present application, it should be understood that the disclosed device may be implemented in other ways. For example, the device embodiments described above are merely illustrative. For example, the division of the unit is only a logical function division. In actual implementation, there may be another division manner. For example, a plurality of units or components may be combined or integrated into another system, or some features may be ignored or not implemented. In addition, the illustrated or discussed mutual coupling or direct coupling or communication connection may be indirect coupling or communication connection through some interfaces, devices or units, and may be electrical or in other forms.

In addition, each functional unit in each embodiment of the present application may be integrated in one processing unit, or each unit may exist alone physically, or two or more units may be integrated in one unit. The above integrated unit may be implemented in the form of hardware or in the form of software program modules.

The embodiments of the present application have been described in detail above. Specific examples are used herein to set forth the principles and the embodiments of the present application, and the descriptions of the above embodiments are only meant to help understanding of the method and the core idea of the present application. Meanwhile, those skilled in the art may make alterations to the specific embodiments and the scope of application in accordance with the idea of the present application. In conclusion, the contents of the present specification shall not be interpreted as limiting to the present application.

What is claimed is:

1. A bulletproof material comprising a plurality of layers of bulletproof fiber cloths and shock-absorption layers, wherein each layer of bulletproof fiber cloth has a plurality of diamond-shaped reinforcing units, and an included angle is formed between two neighboring diamond-shaped reinforcing units of the adjacent bulletproof fiber cloths; a carbon nano layer is provided on the front side of each layer of bulletproof fiber cloth; the carbon nano layer comprises a plurality of diamond-shaped integrated carbon nano tube units; and the plurality of diamond-shaped integrated carbon nano tube units correspond to the plurality of diamond-shaped reinforcing units at positions, wherein each diamond-shaped integrated carbon nano tube unit comprises five integrated carbon nano tubes, wherein four integrated carbon nano tubes form an outer diamond block diagram of the diamond-shaped integrated carbon nano tube unit, remaining one integrated carbon nano tube forms one central line of the outer diamond block diagram.

2. The bulletproof material of claim 1, wherein the integrated carbon nano tube comprises n carbon nano tubes, and the n carbon nano tubes are arranged in random order, wherein the n is an integer greater than or equal to 100.

3. The bulletproof material of claim 2, wherein the diamond-shaped reinforcing unit has an angle of a diamond shape of 60°, 120°, 60°, and 120°, and an included angle of 30° is formed between the diamond-shaped reinforcing units between the adjacent layers of bulletproof fiber cloth.

4. The bulletproof material of claim 1, wherein the shock-absorption layers are made from D3O material, and a shock-absorption layer is provided on every five layers of bulletproof fiber cloths.

5. A production method of the bulletproof material of claim 1, which comprises:

acquiring a plurality of layers of bulletproof fiber cloths, and arranging a plurality of diamond-shaped reinforcing units on the bulletproof fiber cloths, thereby obtaining an initial bulletproof fiber cloth;

continuously winding carbon nano tube continuums around a cylindrical horizontal drum in a high-temperature furnace under the action of air buoyancy, wherein the cylindrical horizontal drum comprises a plurality of diamond-shaped blocks corresponding to the plurality of diamond-shaped integrated carbon nano tube units in sizes, each diamond-shaped block comprises four outer block sides and one central line, and a region among the four outer block sides and the central line is a hollow region; after accumulatively continuously winding for a certain time, spraying alcohol on the surfaces of the obtained continuous integrated carbon nano tubes, using cylindrical steel rollers to pressurize; and after cooling to room temperature, taking off the material from the cylindrical horizontal drum, thereby obtaining a self-standing nano carbon film; and pressing the self-standing nano carbon film onto one surface of each layer of bulletproof fiber cloth in a cold press manner so as to form a bulletproof fiber cloth with integrated carbon nano tubes, and packaging the plurality of layers of bulletproof fiber cloths with integrated carbon nano tubes and the shock-absorption layers so as to obtain the bulletproof material.

6. A bulletproof backpack comprising the bulletproof material of claim 1, and an electronic device, wherein the electronic device comprises a processor, a communication module, a memory, a camera and a pressure sensor; and the communication module, the memory and the camera are respectively connected with the processor, wherein the pressure sensor is provided on the upper side of the double-shoulder strap, and the camera is provided on the front side of the double-shoulder strap, the pressure sensor is configured to detect the pressure value of the double-shoulder strap, the processor is configured to turn on the camera when the pressure value is greater than a pressure threshold, and also configured to remind the user when the image is analyzed to determine that there is a shooting incident, and the camera is configured to acquire an image.

7. The bulletproof backpack of claim 6, wherein the processor is configured to sample a first frame picture and a second frame picture with a set interval, extract a first group of N positions corresponding to the images of N people of the first frame picture, extract a second group of N positions corresponding to the images of the same N people of the second frame picture, acquire N distances between the second group of N positions and the first group of N positions, extract M distances greater than a set threshold from N distances, and determine that there is a shooting incident if M is greater than a set number, N is an integer greater than or equal to 2, and $M \leq N$.

8. The bulletproof backpack of claim 6, wherein the bulletproof backpack further comprises a GPS chip, which is configured to locate a position to acquire GPS coordinates, and the processor is further configured to determine the shooting incident, determine the current position according to the GPS coordinates, acquire the secure position around the current position, generate a path between the secure position and the current position, and provide the path to a user by voice prompting.

* * * * *